United States Patent [19]

Marra

[11] 4,109,760

[45] Aug. 29, 1978

[54] EMERGENCY ESCAPE DEVICE

[76] Inventor: Aldo Marra, 11 Wood St., San Francisco, Calif. 94118

[21] Appl. No.: 792,703

[22] Filed: May 2, 1977

[51] Int. Cl.[2] ..... A62B 1/20

[52] U.S. Cl. ..... 182/48; 182/70

[58] Field of Search ..... 182/48, 49, 70; 193/17, 193/21, 33, 34

[56] References Cited

U.S. PATENT DOCUMENTS 3,838,750 10/1974 Williams ..... 182/48

*Primary Examiner*—Reinaldo P. Machado

*Attorney, Agent, or Firm*—Phillips, Moore, Weissenberger, Lempio & Majestic

[57] ABSTRACT

A device for emergency escape from an elevated position in a structure is disclosed which includes an elongated frame fixable at the bottom, either to the structure or adjacent to the structure. The elongated frame is removably fixable to the structure at the top near the elevated position. An elongated collapsible-extensible slide is affixed to the top of the elongated frame and is itself fixable to the structure by removable means so that release of the frame at the top extends the slide from near the elevated position on the structure into a useable form for escape. Escape is accomplished by an individual sliding down the extended slide.

10 Claims, 8 Drawing Figures

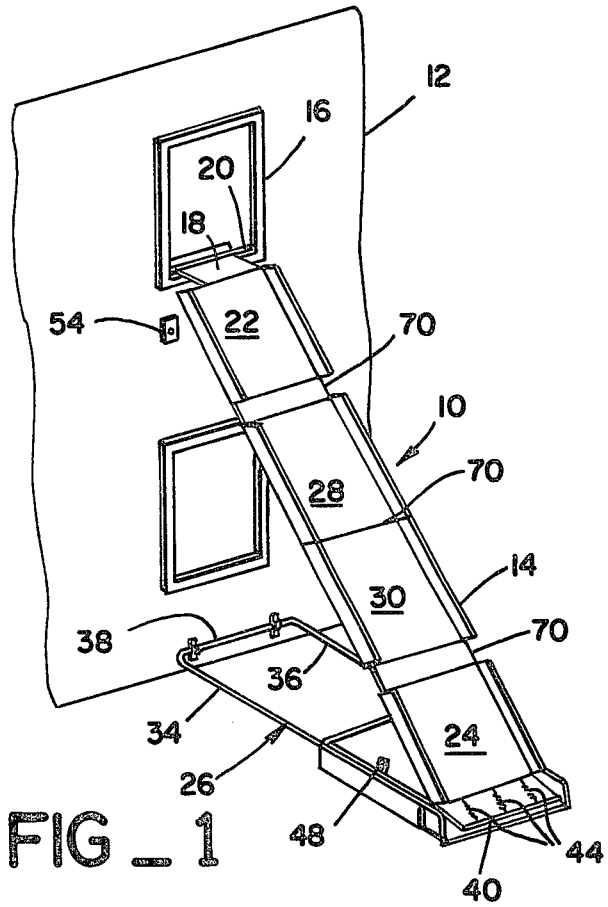
FIG_1
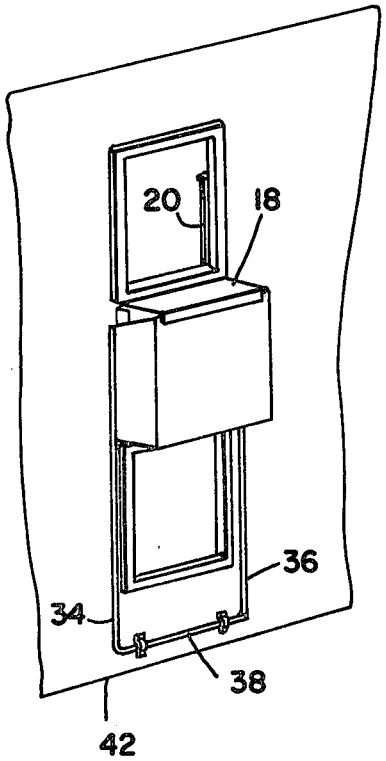
FIG_2
FIG_3
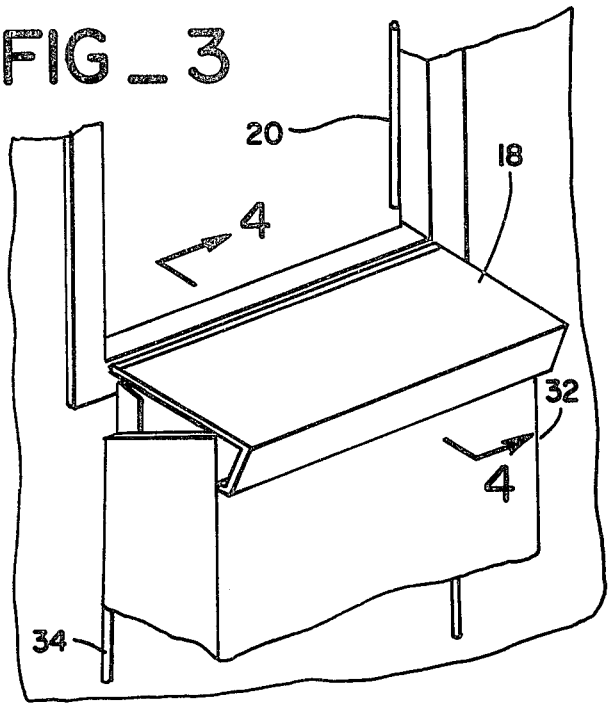
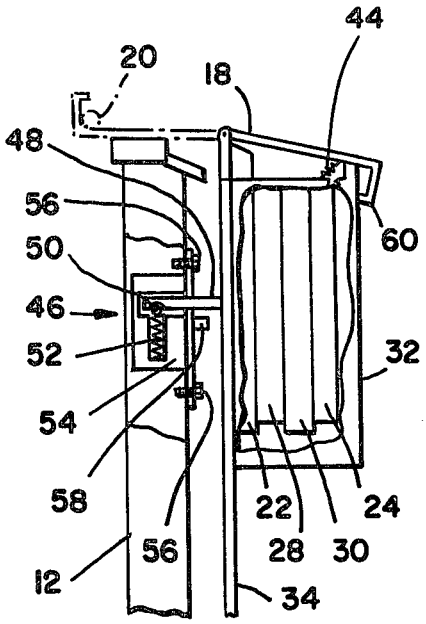
FIG_4

EMERGENCY ESCAPE DEVICE

BACKGROUND OF THE INVENTION

This invention relates to an escape device. In particular, it relates to a collapsible-extensible slide for escape from an elevated position in a structure such as a multi-story building or the like.

Although escape slides have been well known in the art for many years, a particular problem is associated with any exterior escape device affixed to a multi-story building. In particular, such a device must be designed so that an intruder, such as a thief, is unable to utilize the device for illicit entry into a multi-story structure for nefarious purposes. In the past, such illicit entry has been foiled by utilizing folding ladders or retractable ladders for the last flight in an exterior-mounted fire escape. In interior fire escapes, now found in many high-rise buildings, illicit entry may be foiled by a one-way lock so that exit may be accomplished through a fire door while entry is prohibited by the one-way lock.

Although these schemes have proved appropriate in high-rise buildings and in commercial-type installations, the expense and the unsightliness involved in a private dwelling or in a small commercial structure, have precluded widespread use of escape devices in such structures. Accordingly, it is appropriate to provide an escape device which may be used in a private dwelling or in a small commerical structure which precludes illicit entry by a thief or the like and, further, to provide such a device which is economical to construct and is not particularly unsightly.

BRIEF DESCRIPTION OF THE PREFERRED EMBODIMENT

This invention is a device for emergency escape from an elevated position in a structure. The device comprises an elongated frame rigidly fixable at a first end to the structure or to a position adjacent to the structure at or near the ground level and removably fixable at the second opposite end to the structure adjacent the elevated position. An elongated collapsible-extensible slide is rigidly affixed at one end with the second end of the elongated frame and is also removably fixable at the other second end of the collapsible-extensible slide adjacent the elevated position of the structure independent of the elongated frame. A locking mechanism is operable from the elevated position of the structure for lockingly engaging the second end of the collapsible-extensible slide with the structure immediately adjacent the elevated position, and for releasing the second end of the elongated frame. Release of the elongated frame by the locking mechanism allows the frame to rotate through an arc to lie adjacent the ground level and extend the collapsible-extensible slide for allowing human escape fron the elevated position.

BRIEF DESCRIPTION OF THE DRAWINGS

FIG. 1 shows the escape device in accord with this invention in the extended position.

FIG. 2 shows the same escape device illustrated in FIG. 1 in the stowed position.

FIG. 3 is a detail of the upper portion of the escape device shown in FIG. 2.

FIG. 4 is a cross-sectional view of the escape device in FIG. 3 shown at line 4—4.

DETAILED DESCRIPTION OF THE PREFERRED EMBODIMENT

Figure 7:
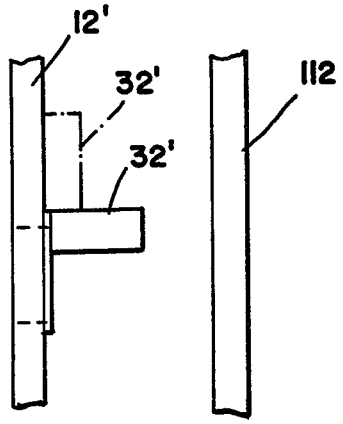
FIG. 7 is a plan view of the escape device shown in FIG. 6.

Referring to FIG. 1, an escape device 10 is shown associated with a structure such as a multi-story building 12.

Escape device 10 is comprised of an elongated collapsible-extensible slide 14 which may be associated with multi-story building 12 by a means such as a locking mechanism operable for locking the slide to an elevated position on the multi-story building 12, such as in the vicinity of a window 16. The locking mechanism may comprise a hinged plate member 18 and a locking bar 20. Plate member 18 is hingedly associated by means well known in the art to one element 22 of a plurality of elements which comprise the collapsible-extensible slide 14. In particular, element 22 is at the extreme end of the plurality of elements, while at the other opposite end of the collapsible-extensible slide 14 is a second specially configured slide element 24, which is affixed to an elongated frame 26. Disposed between slide element 22 and slide element 24 are a plurality of alternating elements, such as 28 and 30, which are hingedly associated one with the other in an end-to-end relation so that the entire slide may be folded into an accordion configuration and stowed in a box member 32, also associated with elongated frame 26 at the end to which slide element 24 is affixed.

Elongated frame 26 is comprised of two longitudinal members 34 and 36. Longitudinal members 34 and 36 are spatially separated at each end by lateral end members 38 and 40, member 38 at the lower end and member 40 at the upper end. Lateral end member 38 may be fixedly associated with multi-story building 12 as indicated in FIGS. 1 and 2, by permanent fixture at the ground level 42 of multi-story building 12. Fastening means, such as pillow blocks or the like, would be appropriate for fixture of lateral end member 38, which could act as a shaft or axle with the base of multi-story building 12, so that frame 26, in the preferred embodiment, may rotate in an arc in a plane normal to the side of the multi-story building 12.

As previously noted, slide element 24 forms the last element in the collapsible-extensible slide 14 and is affixed to elongated frame 26 at lateral end member 40. Appropriate fastening means, such as resilient members, for example, helical springs 44, would be appropriate to give a degree of resiliency to the collapsible-extensible slide 14 when in the deployed condition as shown in FIG. 1.

Figure 8:
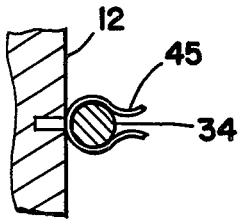
FIG. 8 is a plan view in section of a spring clip for removably fixing the device to a structure.

Referring to FIG. 4, where the collapsible-extensible slide 14 is shown in its stowed or folded condition, it can be seen that longitudinal member 34 is associated with a structure or multi-story building 12 by a break-way fixture means 46. For example, a spring clip 45 (see FIG. 8) may be used or a more permanent detent structure including a pin member affixed to each longitudinal member 34 and 36 of frame 26 to extend outwardly therefrom in the direction of the structure 12. These pin members 48 may be formed with a detent groove 50 adapted to engage a detent 52 formed in a fastening member 54, which may be associated with or placed in the wall of multi-story building 12 by appropriate fastening means, such as bolts 56. The purpose of this fastening device will be apparent in a discussion of the operation of the escape mechanism; however, suffice it to say that the detent 52 is set so that if an attempt is made to climb the longitudinal members 34 and 36 from the ground level 42 upwardly toward the window 16, the entire elongated frame 26 and the collapsible-extensible slide 14 will rotate downwardly thus thwarting illicit entry. It will become apparent in the discussion of the operation that until plate member 18 is rotated back into the window and locking bar 20 is placed in position, the collapsible-extensible slide 14 remains in box member 32. Thus, an attempt to climb the collapsible-extensible slide 14 by deploying the slide from the ground will also fail. Additionally, it should be apparent to those in the art that an alarm box 58 of a type well known in the art may be associated with the deivce, for example, at fastening member 54, so that withdrawal of pin 48 from fastening member 54 will sound an alarm in the alarm box 58. Alarm box 58 may be battery-powered if desired. Alarm box 58 could also be affixed in other ways to sound upon deployment of the slide.

Operation of the preferred embodiment first entails positioning plate member 18 in the window opening, as indicated in FIG. 1 and as shown in phantom lines in FIG. 4. As previously mentioned, plate member 18 is hingedly associated with the upper slide element 22 of collapsible-extensible slide 14. Once plate member 18 is deployed in the window opening of window 16, locking bar 20 may be rotated from its stowed position, as shown in FIG. 2, downwardly across plate member 18. It should be apparent from inspection of the drawings that plate member 18 has a lip 60 which overlaps box 32. Lip 60, when plate member 18 is rotated approximately 180° in the counter-clockwise direction, as shown in FIG. 4, is sufficient to lock the plate member 18 in a fixed relationship relative window 16. It will be remembered from a description of the structure, that plate member 18 is affixed to the slide element 22 forming the upper end of collapsible-extensible slide 14. Thus, once plate member 18 is in the locked position as indicated, the user of the slide may then push outwardly of box member 32 from inside the window 16 so that the elongated frame 26 rotates clockwise, as shown in either FIG. 1 or FIG. 4, to unfold the collapsible-extensible slide 14 into the deployed condition shown in FIG. 1.

In order to prevent collapsing of the collapsible-extensible slide 14, or folding up of the slide during use by a human, the outer end of elongated frame 26, in particular the box member 32, may be weighted sufficiently to cause a minimal deflection upwardly when a human body starts sliding downwardly of the collapsible-extensible slide 14. Of course, it is clear to those in the art that as the mass of the human body passes downwardly of the slide, the dynamic forces created thereby will, in fact, raise the outer end of the elongated frame 26 to a degree from the ground. However, as the body approaches the outer extremity of the elongated frame, as shown in FIG. 1, the whole apparatus will again approach the ground. Resilient members 44 will tend to take up a certain degree of shock as the body passes down the slide.

In the stowed condition, as indicated in FIG. 4, the plate member 18 serves a second purpose, that of protecting the individual slide elements 22 from accumulating dirt and moisture while positioned outside the building. The plate member 18 may be purposely sloped, as indicated in FIG. 4, so that rain, water, or snow and the like will not accumulate in the box 32.

It should be understood also that each individual slide element 22, 28, 30, 24, may be made of a relatively rigid material, such as a plastomer, and affixed one to the other by hinge means well known in the art, in particular, a flexible plastomer as indicated at 70. Other hinge means to associate the separate elements one with the other would be appropriate. Furthermore, each element may overlap the next lower element.

Figure 6:
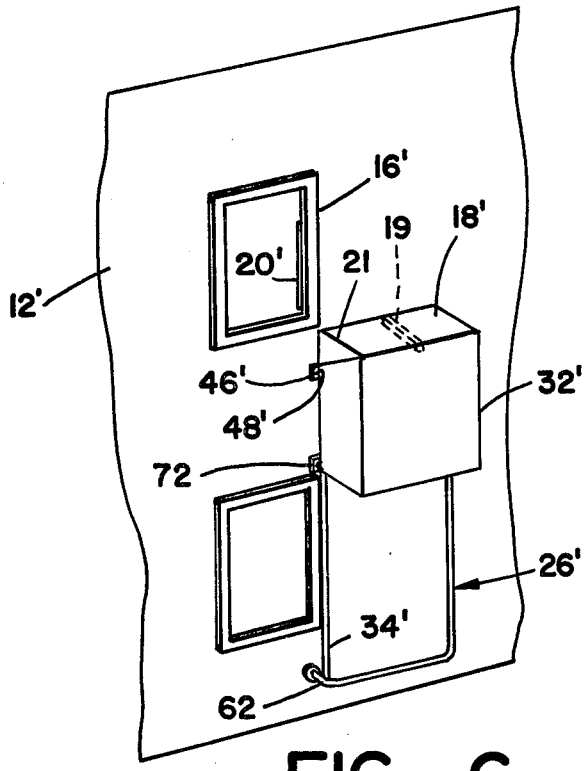
FIG. 6 is a view of the escape device shown in FIG. 5 in the stowed position.
Figure 5:
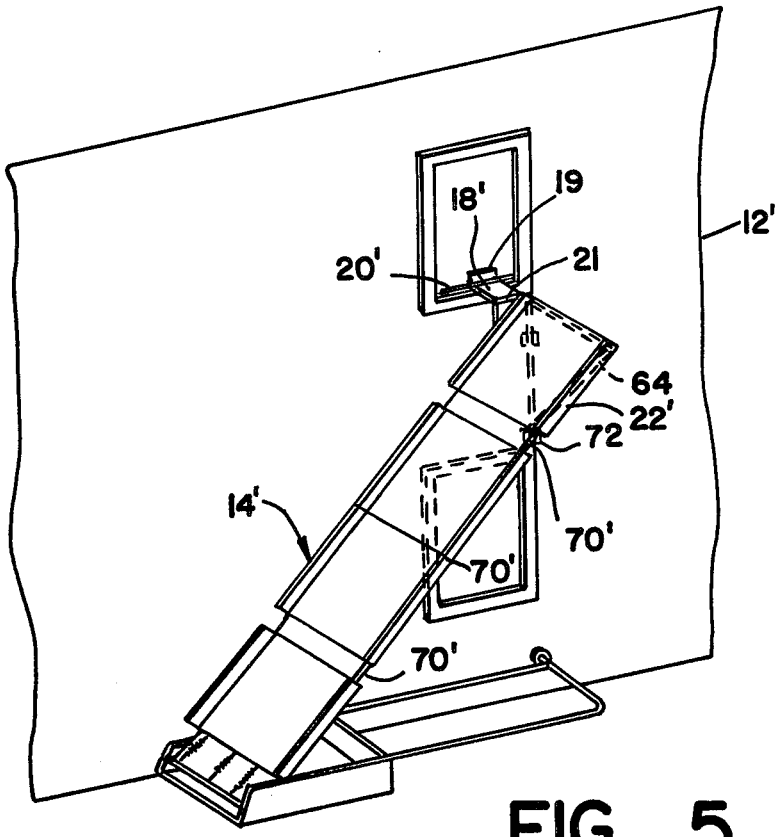
FIG. 5 is an alternate embodiment of the escape device shown in FIG. 1, also in the extended position.

An alternate embodiment of the aforedescribed escape device is shown in FIGS. 5, 6, and 7. Like elements are shown with like numbers, while similar elements are shown with the same number and a prime.

The embodiment shown in FIGS. 5, 6, and 7 is particularly adapted for use in a structure position in close proximity to another structure so that use of the primary embodiment would not be possible as rotation of the escape slide, as indicated in FIG. 1, would contact the adjacent structure. This particular embodiment is illustrated in plan view in FIG. 7, and is shown affixed to a structure 12', while the second building 112 is immediately adjacent the original building 12'. In this embodiment, the elongated frame 26' would appear to be displaced from windown 16' so that escape would not be possible. However, the elongated frame 26° is fixed to the building by one elongated member 34' and hinge means 62. At the top of elongated member 34' a break-away fitting, in the manner of break-away fitting 46 in the primary embodiment, holds elongated member 34' adjacent the elevated position on the structure 12'. Fitting 46' which affixes a bracket 64 to structure 12' is configured to receive a hinged pin member 48' so that the entire elongated frame 26' may be swung at right angles to the building, as shown in FIG. 7 in the plan view. Hinged pin member 48' is further adapted to break-away from bracket 64 which remains removably affixed to structure 12' upon deployment of the slide. Cover 18' serves the same useful purposes as in the primary embodiment, that is, to protect the stowed slide and to lock the collapsible-extensible slide 14' relative the elevated position through the use of a locking bar 20'. The bracket 64 is affixed to the slide element 22' for additional rigidity of the upper end of the deployed collapsible-extensible slide. Bracket 64 may be triangular in nature to extend downwardly of the side of structure 12' and prevent a turning movement from rotating the upper end of the collapsible-extensible slide 14. A supplemental break-away-type fitting 72, similar to fitting 46', may be used at the lower end of bracket 64.

Operation of the alternate embodiment is similar to that of the primary embodiment; however, before deployment of the slide, the user in the elevated position of structure 12' will rotate the entire assembly 90° so that deployment of the elongated member 26' may occur in a plane parallel to the face of structure 12'. Cover 18', which is hingedly affixed to slide 14' at one end 21, is folded back into the opening of window 16'. Bar 20' locks the member 18' relative the building 12' so that deployment of the collapsible-extensible slide 14' may occur in the manner shown in FIG. 5. Cover 18' may include an additional hinge to allow the extreme end of cover 18' to fold down inside the window. A cleat 19 should be positioned on cover 18' so that cover 18' will not slide free. As previously mentioned, the break-away fittings 46' and 72 will prevent the structure from being utilized for nefarious entry of building 12 with the slide in the stowed position, as an outward force imparted by a person climbing the frame will result in the entire structure falling away from structure 12'.

Embodiments of the invention in which an exclusive property or privilege is claimed are defined as follows:

1. An escape device for emergency escape from an elevated position in a structure comprising:

elongated frame means rigidly associatable at a first end to said structure adjacent to ground level and removeably fixable in a first position at the second opposite end of said frame means to said structure adjacent said elevated position;

elongated collapsible-extensible slide means rigidly affixed at one end with said second end of said frame means and fixable adjacent said elevated position to said structure independent of said elongated frame means at the other second end of said collapsible-extensible slide means;

lock means operable from said elevated position for lockingly engaging said second end of said collapsible-extensible slide means with said structure immediately adjacent said elevated position and for releasing said second end of said elongated frame means so that said frame means is allowed to rotate through an arc to lie adjacent the ground level in a second position and extend said collapsible-extensible slide means whereby human escape may occur from said elevated position by sliding down the extended collapsible-extensible slide means;

and further wherein the collapsible-extensible slide means comprises a plurality of rigid members each hinged in an accordian fashion in an end-to-end relationship one with the next.

2. The escape device of claim 1 wherein the second end of elongated frame means comprises a weighted portion.

3. The escape device of claim 2 wherein the elongated frame means further comprises two longitudinal members, a top lateral member and a bottom lateral member;

said top lateral member interconnecting said two longitudinal members at one end thereof;

said bottom lateral member forming a part of the weighted portion and interconnecting said two longitudinal members at the other opposite end;

the lock means releasably affixed to said bottom lateral member.

4. The escape device of claim 1 wherein the lock means comprises:

a cover plate hingedly fixed to the second end of the collapsible-extensible slide means; and a locking bar fixable to the structure, said locking bar while affixed to said structure rotatable through an arc to engage said hingeable cover plate to fixedly associate said collapsible-extensible slide means with said structure.

5. The escape device of claim 4 further comprising a break-away fitting including a pin member affixed to the elongated frame means proximate the second end thereof and defining a detent groove and detent means fixable to said structure for releasably receiving said pin member whereby said elongated frame means may be retained proximate said structure.

6. The escape device of claim 5 further comprising alarm means associated with said pin member and said detent means for sounding an alarm upon separation of said pin member and said detent means.

7. The escape device of claim 6 wherein the second end of elongated frame means comprises a weighted portion.

8. The escape device of claim 7 wherein the elongated frame means further comprises two longitudinal members, a top lateral member and a bottom lateral member;

said top lateral member interconnecting said two longitudinal members at one end thereof;

said bottom lateral member forming a part of the weighted portion and interconnecting said two longitudinal members at the other opposite end;

the lock means releasably affixed to said bottom lateral member.

9. The escape device of claim 8 wherein the elongated frame means further comprises a box member affixed to the second end thereof, said box member for receiving said collapsible-extensible slide means with said elongated frame means in a first position.

10. The escape device of claim 4 further comprising a clamp member fixable to the structure proximate the elevated position thereof to releasably receive the elongated frame means.

* * * * *